US009139268B2

(12) United States Patent
Jadallah Jadallah et al.

(10) Patent No.: US 9,139,268 B2
(45) Date of Patent: Sep. 22, 2015

(54) METHODS AND SYSTEMS FOR DETACHING COMPARTMENTS ATTACHED TO A WATERCRAFT

(71) Applicants: Yousef Jadallah Jadallah, Ramallah (PS); Jadallah Jadallah, Ramallah (PS)

(72) Inventors: Yousef Jadallah Jadallah, Ramallah (PS); Jadallah Jadallah, Ramallah (PS)

( * ) Notice: Subject to any disclaimer, the term of this patent is extended or adjusted under 35 U.S.C. 154(b) by 0 days.

(21) Appl. No.: 14/517,240

(22) Filed: Oct. 17, 2014

(65) Prior Publication Data

US 2015/0112520 A1 Apr. 23, 2015

Related U.S. Application Data

(60) Provisional application No. 61/891,982, filed on Oct. 17, 2013.

(51) Int. Cl.
*B63B 43/18* (2006.01)
*B63B 59/00* (2006.01)

(52) U.S. Cl.
CPC ..... *B63B 43/18* (2013.01); *B63B 59/00* (2013.01)

(58) Field of Classification Search
CPC ..... B63B 43/18; B63B 59/00
USPC ..... 701/21
See application file for complete search history.

(56) References Cited

U.S. PATENT DOCUMENTS 4,254,729 A * 3/1981 Muller ..... 114/280

OTHER PUBLICATIONS

"Step 2013: Palestinian Science & Technology Entrepreneurship Program", National Exhibition and Competition Booklet, May 2013, p. 53.

* cited by examiner

*Primary Examiner* — Mary Cheung
*Assistant Examiner* — Yuen Wong
(74) *Attorney, Agent, or Firm* — Sughrue Mion, PLLC

(57) ABSTRACT

A method and system for detaching one or more compartments attached to a watercraft in response to a detected event, the method including detecting an event with respect to a compartment attached to the watercraft and causing, in response to detecting the event, a release of one or more attaching members that attach the compartment to the watercraft.

11 Claims, 6 Drawing Sheets

METHODS AND SYSTEMS FOR DETACHING COMPARTMENTS ATTACHED TO A WATERCRAFT

CROSS-REFERENCE TO RELATED PATENT APPLICATION

This application claims priority from U.S. Provisional Application No. 61/891,982 filed on Oct. 17, 2013, the disclosure of which is incorporated herein by reference in its entirety.

BACKGROUND

1. Technical Field

One or more exemplary embodiments relate to methods and systems for detaching one or more compartments attached to a watercraft in response to a detected event such as damage to the compartment.

2. Description of the Related Art

In the related art, there have been known ships in which a hull has a series of air containing cells around and below the water level. This way, damage to the hull itself can be minimized and the cells surrounding the hull can be replaced if they are damaged during a collision (e.g., see GB 1912/11858 and U.S. Pat. No. 1,729,120).

More recently, a vessel has been disclosed which is equipped with collision guards made in the form of a plurality of watertight modules secured to the exterior surface of the hull and supported thereby (U.S. Pat. No. 5,353,727). The modules are not identical but are shaped to conform along their inner walls to the streamlined exterior walls of the port and starboard.

In case of a collision, the module(s) can be removed and replaced by a new identical module, or simply repaired. In order to dismantle one of the modules, the brackets supporting the box enclosure are removed to separate the module from its engagement with a side of the hull. This technique requires dismantling the compartments at the port using a port crane.

SUMMARY

In the related art, there is no technique disclosed for detaching watertight compartments (attached to watercraft for protecting the watercraft body in case of a collision or from other sources of damage) automatically and while at sea in a situation where the water level in a damaged compartment reaches a predetermined level which may be viewed as a critical level.

As water filling up in a damaged compartment will degrade the watercraft's balance as well as its load and in may even prohibit the watercraft from continuing its journey (e.g., to the closest port), it would be desirable to detach the damaged compartment as soon as possible.

Non-limiting embodiments of the present application, however, provide the ability of detaching a compartment attached to the watercraft as soon as possible in response to detecting an event related to the compartment. The detachment could take place while the watercraft is in the midst of its journey.

Accordingly, a non-limiting embodiment provides a method for detaching one or more compartments attached to a watercraft in response to a detected event, the method including detecting an event with respect to at least one compartment attached to the watercraft; and causing, in response to detecting the event, a release of one or more attaching members that attach the at least one compartment to the watercraft.

The event could be water level reaching a predetermined point in the at least one compartment.

The detecting may include detecting the event using a mechanical float installed in the at least one compartment.

The mechanical float may be configured to move in a predetermined direction in response to the water level rising in the compartment, and may be configured to cause the release of the one or more attaching members in response to the water level reaching the predetermined point in the at least one compartment.

The detecting may include detecting the event using a detector installed in the at least one compartment.

The detector may detect whether the water level reaches the predetermined point in the at least one compartment and may output a signal to a controller included in the at least one compartment in response to detecting that the water level reaches the predetermined point.

The controller, in response to receiving the signal, may activate an actuator which causes the release of the one or more attaching members that attach the at least one compartment to the watercraft.

Another non-limiting embodiment provides a system for detaching one or more compartments attached to a watercraft in response to a detected event, the system including a float which detects an event with respect to at least one compartment attached to the watercraft and which causes, in response to detecting the event, a release of one or more attaching members that attach the at least one compartment to the watercraft.

The detected event may be water level reaching a predetermined point in the at least one compartment.

The float may be a mechanical float configured to move in a predetermined direction in response to the water level rising in the compartment, and configured to cause the release of the one or more attaching members in response to the water level reaching the predetermined point in the at least one compartment.

Another non-limiting embodiment provides a system for detaching one or more compartments attached to a watercraft in response to a detected event, the system including one or more processors configured to receive detection information regarding a detected event with respect to at least one compartment attached to the watercraft; and causing, in response to receiving the detection information, a release of one or more attaching members that attach the at least one compartment to the watercraft.

They system may further include a detector which detects the event, generates the detection information based on the detected event, and outputs the detection information to the one or more processors.

The one or more processors, in response to receiving the detection information, may cause the release of the one or more attaching members by activating an actuator which releases the one or more attaching members.

DETAILED DESCRIPTION OF EXEMPLARY EMBODIMENTS

Figure 1:
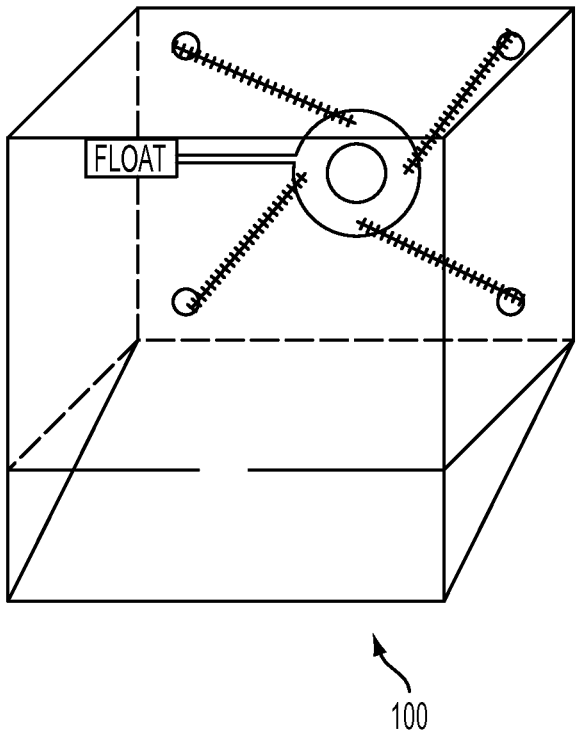
FIG. 1 is a three-dimensional view of a compartment according to a non-limiting embodiment.

All terms including descriptive or technical terms which are used herein should be construed as having their plain and ordinary meanings. However, the terms may have different meanings according to an intention of one of ordinary skill in the art, precedent cases, or the appearance of new technologies. Also, some terms may be arbitrarily selected by the applicant, and in this case, the meaning of the selected terms will be described in detail in the detailed description. Thus, the terms used herein have to be defined based on the meaning of the terms together with the description throughout the specification.

Also, when a part "includes" or "comprises" an element, unless there is a particular description contrary thereto, the part may further include other elements, not excluding the other elements. In the following description, terms such as "unit" and "module" indicate a unit for processing at least one function or operation, wherein the unit and the block may be embodied as hardware or software or may be embodied by combining hardware and software.

One or more exemplary embodiments will now be described more fully with reference to the accompanying drawings. However, the one or more exemplary embodiments may be embodied in many different forms, and should not be construed as being limited to the exemplary embodiments set forth herein. Rather, these exemplary embodiments are provided so that this disclosure will be thorough and complete, and will fully convey the concept of the one or more exemplary embodiments to those of ordinary skill in the art. In the following description, well-known functions or constructions are not described in detail since they would obscure the one or more exemplar embodiments with unnecessary detail, and like reference numerals in the drawings denote like or similar elements throughout the specification.

It will be readily understood that the components of the present invention, as generally described and illustrated in the figures herein, may be arranged and designed in a wide variety of different configurations. Thus, the following more detailed description of the embodiments as represented in FIGS. 1-5, is not intended to limit the scope of the invention, as claimed, but is merely representative of selected embodiments of the invention.

Referring now to FIGS. 1-5, methods and systems for detaching one or more compartments attached to a watercraft in response to a detected event will be described.

FIG. 1 is a three-dimensional view of a compartment 100 according to a non-limiting embodiment. Multiple compartments 100 can be attached to an exterior surface of a watercraft (e.g., a ship hull) as shown in FIG. 2C, which shows a side view of the compartments 100 attached to the ship hull 1. The compartments 100 can be water-tight or air-tight compartments.

Figure 2A:
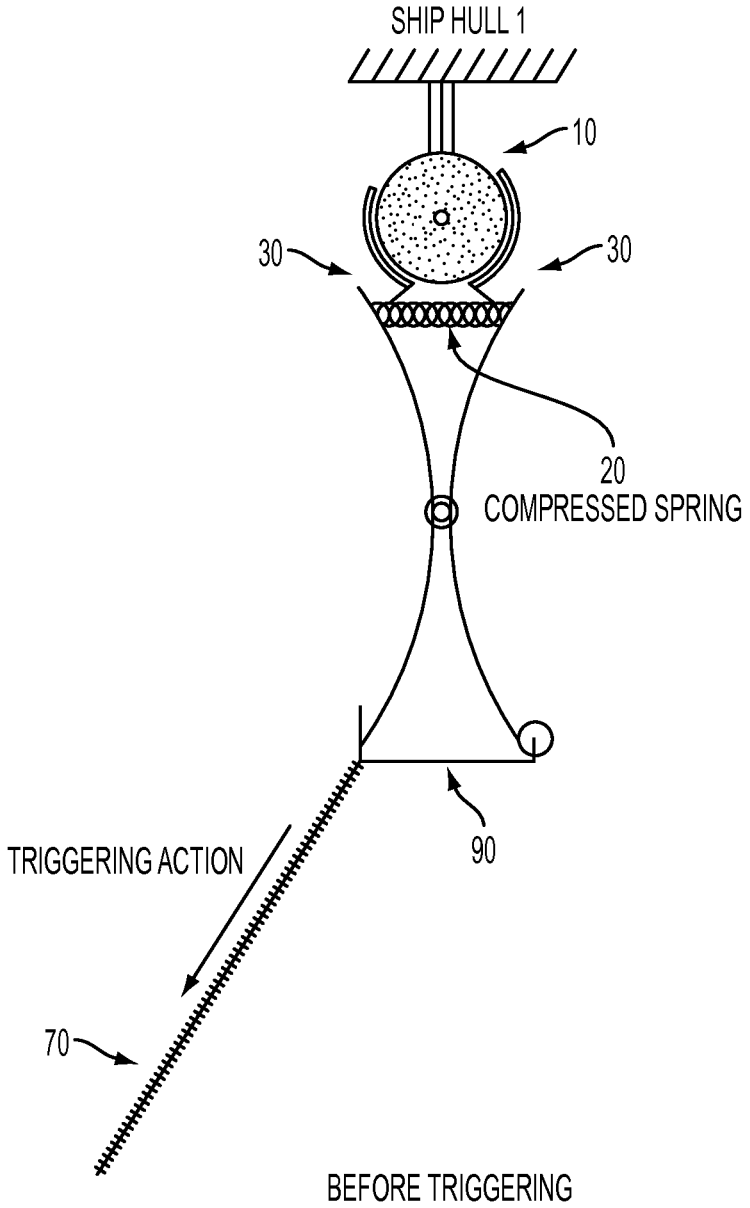
FIG. 2A is a top view of the clamp releasing mechanism before the clamp is released.
Figure 2B:
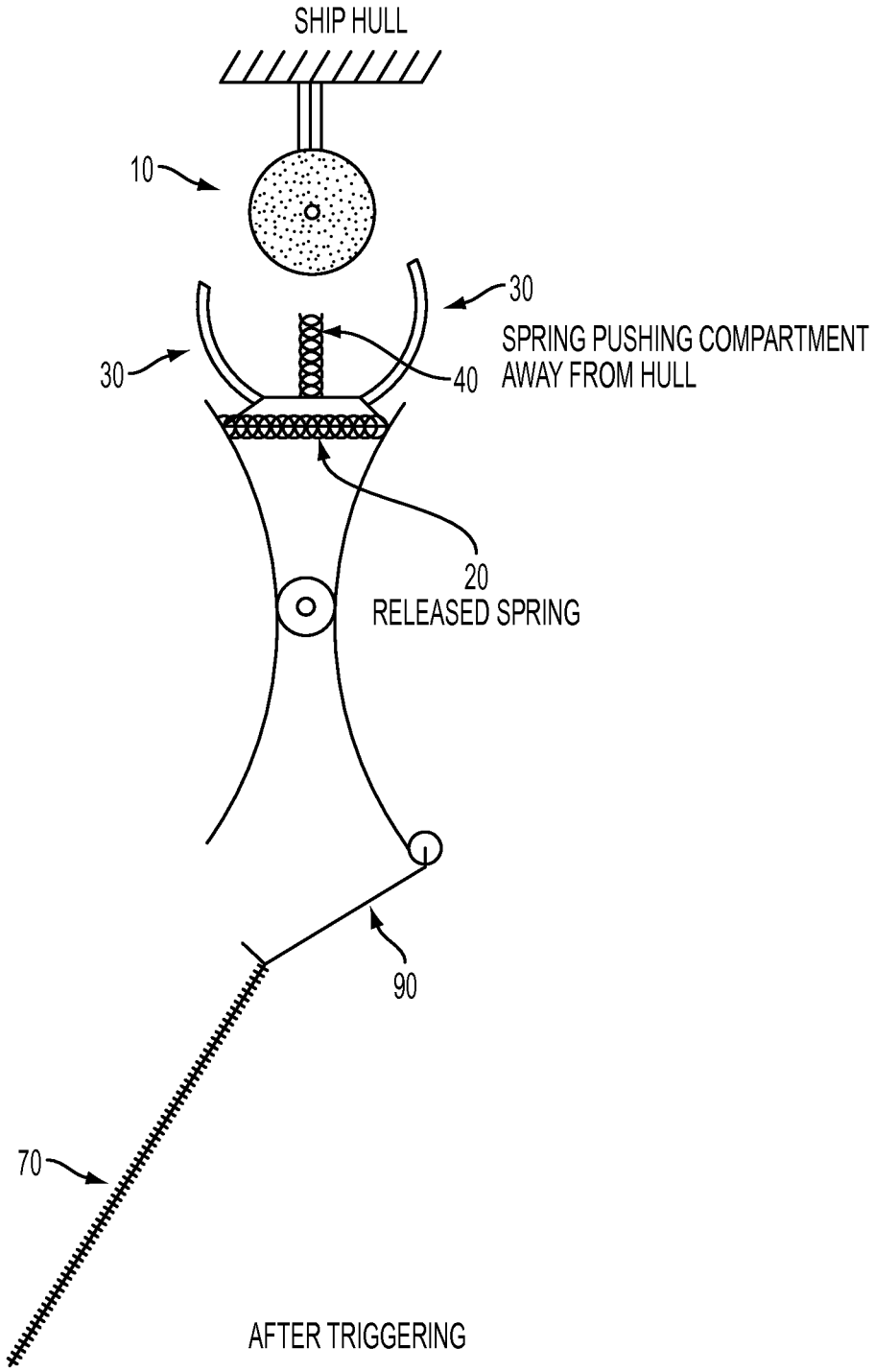
FIG. 2B is a top view of the clamp releasing mechanism after the clamp is released.
Figure 2C:
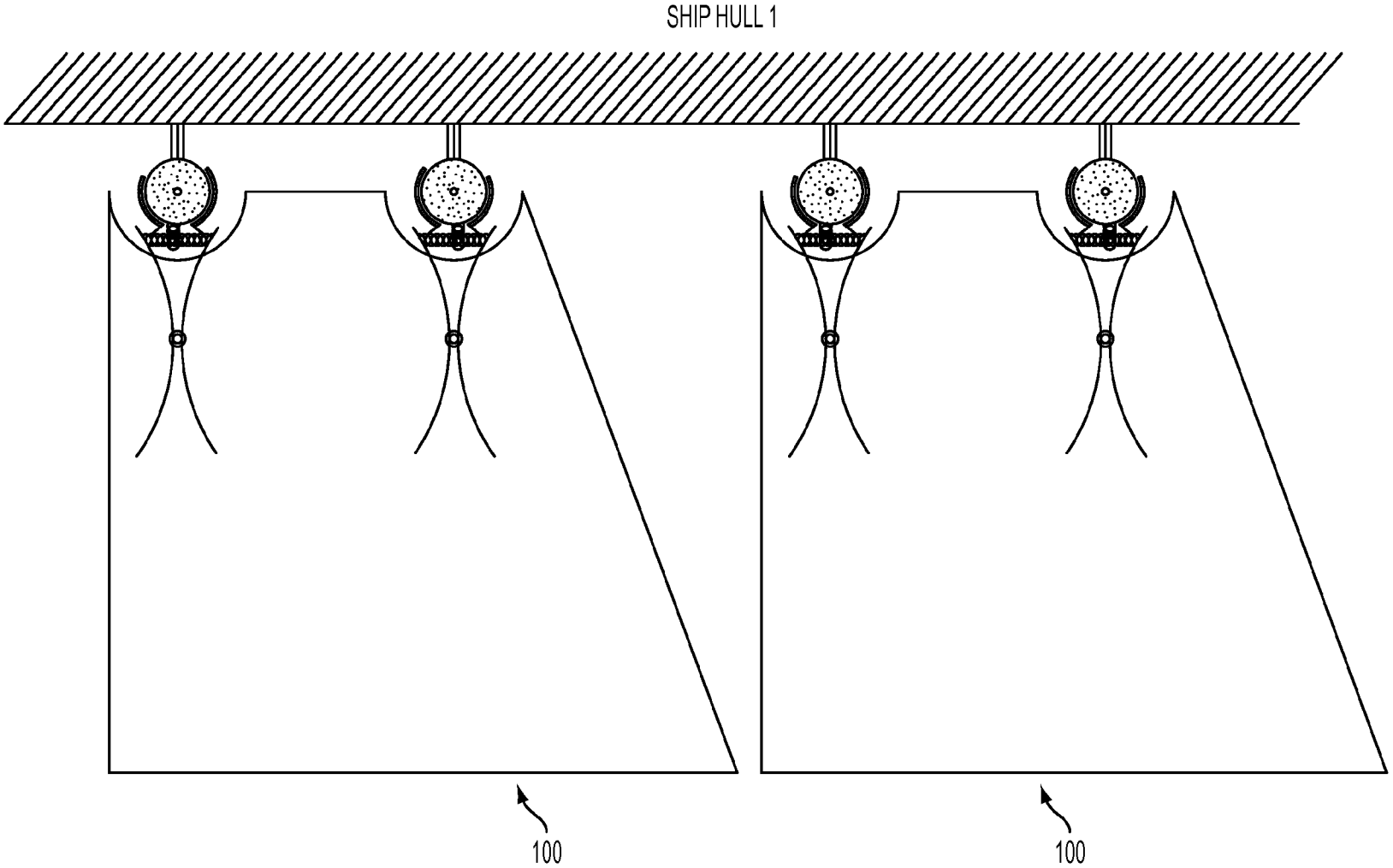
FIG. 2C is a side view of the compartment attached to the ship hull.

The attachment of the compartments 100 to the ship hull 1 is described with respect to FIGS. 2A and 2B.

Protrusions are fixed to the ship hull 1, having the form of a knob 10, and each compartment 100 may be attached to four knobs 10 (to maintain stability) using spring loaded clamps (including a horizontal spring 20, a vertical spring 40, and jaws 30).

Under normal operations, i.e., when the compartment 100 is not released or does not need to be released, each spring loaded clamp 20/30/40 will be closed holding the knobs 10 between its jaws 30. Each clamp 20/30/40 is equipped with a spring loaded trigger mechanism 90 that opens the clamp 20/30/40 instantly once activated.

Loaded springs (vertical springs 40) are placed between the compartment 100 and the ship hull 1. The function of the vertical springs 40 is to push the compartment 100 away from the ship hull 1 once the vertical springs 40 are released.

The form of each compartment 100 will help it slide away once released and pushed away by the vertical springs 40. This way, a compartment 100 can be released without interfering with adjacent compartments 100.

Figure 3:
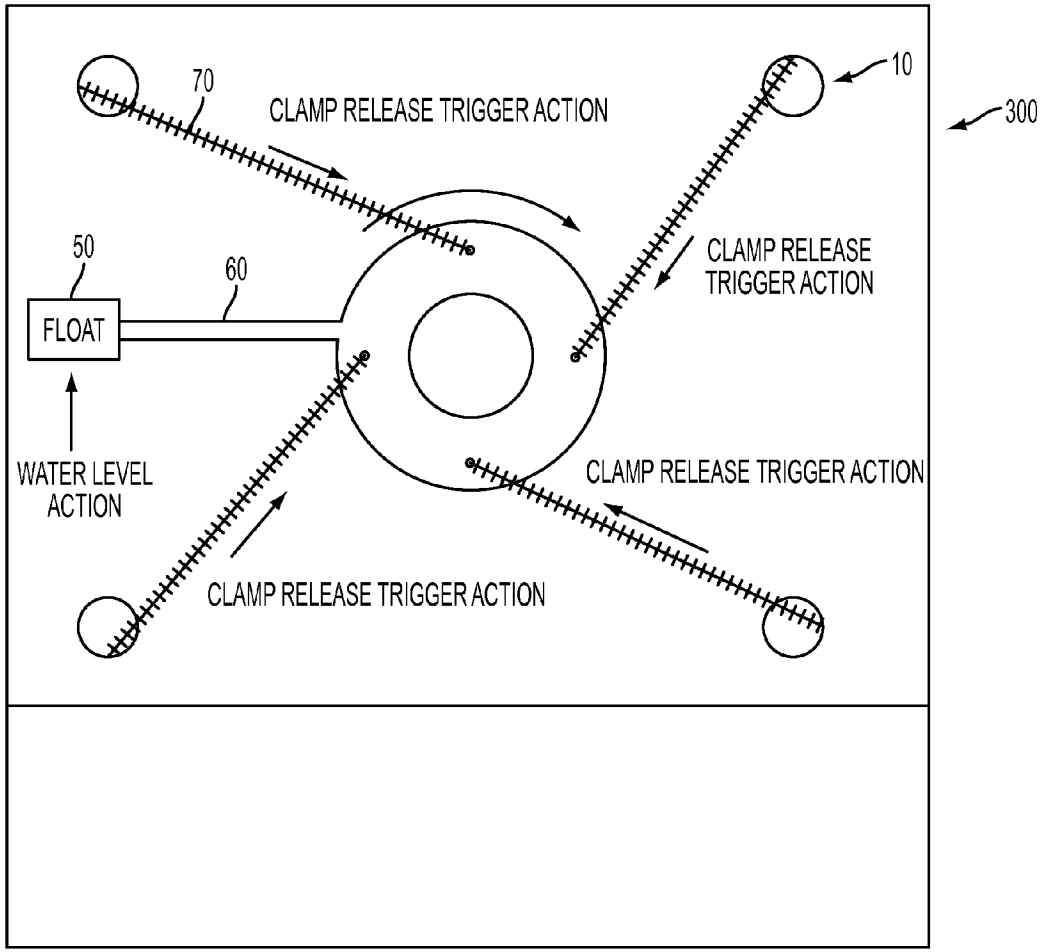
FIG. 3 is a front view of a water level triggering action using a mechanical system in accordance with a non-limiting embodiment.

FIG. 3 is a front view of a water level triggering action using a mechanical system in accordance with a non-limiting embodiment.

In FIG. 3, an automatic releasing mechanism based on a mechanical system 300 is shown.

The mechanical system 300 includes a mechanical float 50 installed inside each of the compartment 100. An articulated arm 60 will link the float 50 to the release mechanism 90 of each clamp via cables 70.

Once a compartment 100 is damaged and fills up, water will push the float 50 upwards. For example, the compartment 100 may be damaged due to the ship being involved in a collision. Or debris in the water may cause damage to the compartment 100.

If the compartment 100 is damaged and breached such that water starts filling into the compartment 100, then when the water level reaches a critical point, the float 50 (at this pre-adjusted position) will trigger the release of all clamps 20/30/40 simultaneously via the release mechanism 90.

Accordingly, the compartment 100 will be pushed away from the ship body 1 by the preloaded springs 40.

The system described above is purely mechanical, the only source of energy being the loaded springs 20/40. As such, the system can work in an autonomous and independent manner.

In case a forced detachment is required (i.e., the compartments need to be detached manually), a hydraulic system can be added to the system of FIG. 3 to trigger the clamps 20/30/40.

Figure 4:
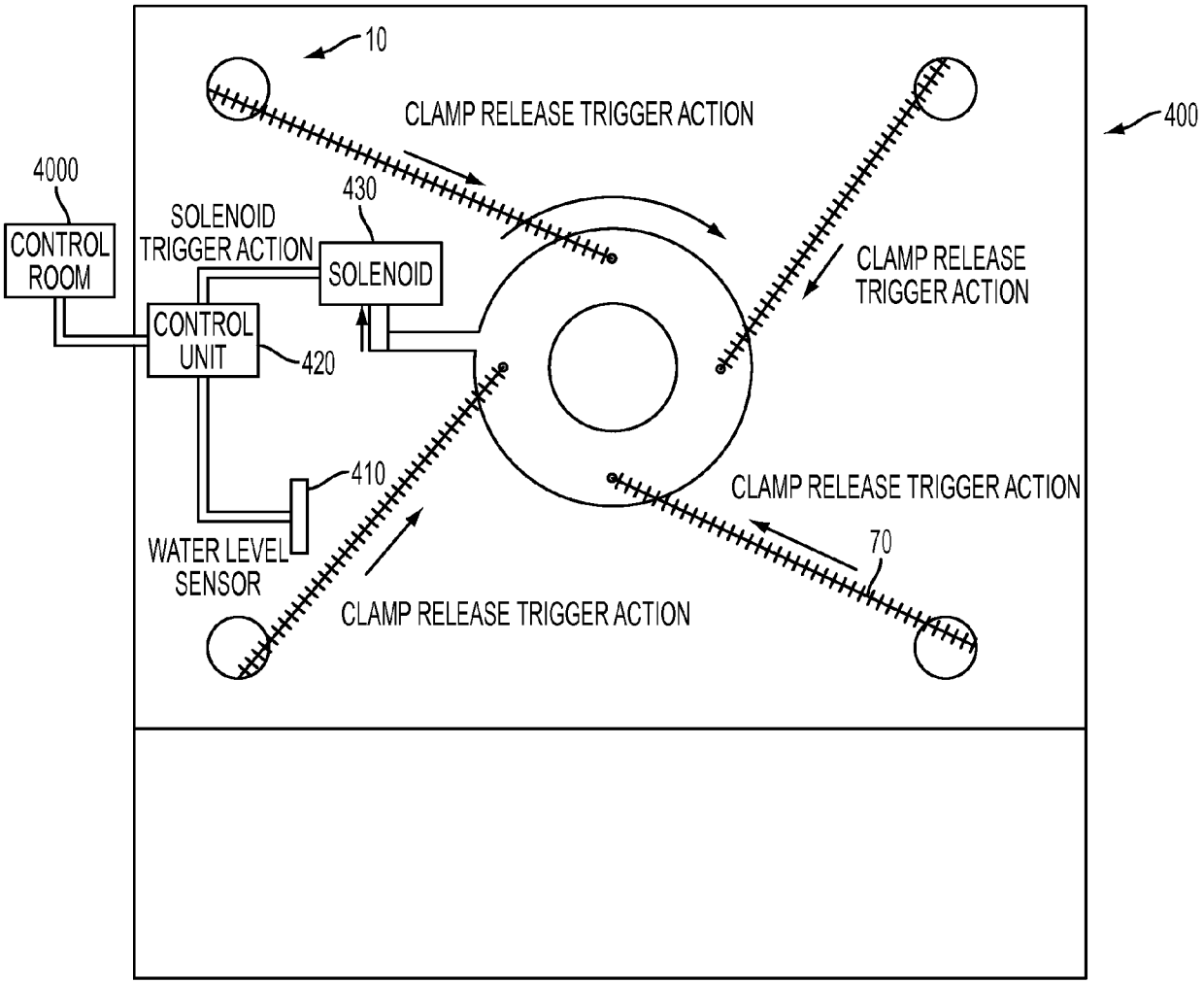
FIG. 4 is a front view of a water level triggering action using an electro-mechanical system in accordance with a non-limiting embodiment.

FIG. 4 is a front view of a water level triggering action using an electro-mechanical system in accordance with a non-limiting embodiment.

In FIG. 4, an automatic releasing mechanism based on an electro-mechanical system 400 is shown.

In the system of FIG. 4, the attachment of the compartment 100 to the ship hull 1 is similar to the other embodiments described above. The difference between the embodiment illustrated in FIG. 4 and the embodiment illustrated in FIG. 3 is that instead of the float 50, we an electronic water sensor 410 and control system/controller 420 (e.g., one or more CPUs) is used along with a solenoid actuator 430.

Once the water sensor 410 detects a critical water level, the controller 420 activates the solenoid actuator 430 which will instantly trigger the release mechanism 90. The release mechanism 90 is the same as used in the mechanical system described with respect to FIG. 3.

One advantage of the electro-mechanical system 400 of FIG. 4 is the possibility of manual override from a remote location (control room) 4000 using a simple override switch. The switch would instruct the controller 420 to activate the solenoid 430.

The system 400 would require an electrical source of energy to operate, and this can be implemented using either an electrical network installation or by installing proper batteries in each compartment.

One or more exemplary embodiments may also be embodied as programmed commands to be executed in various computer means, and then may be recorded to a computer-readable storage medium. The computer-readable storage medium may include one or more of the programmed commands, data files, data structures, or the like. The programmed commands recorded to the computer-readable storage medium may be particularly designed or configured for one or more exemplary embodiments. Examples of the computer-readable storage medium include magnetic media including hard disks, magnetic tapes, and floppy disks, optical media including CD-ROMs and DVDs, magneto-optical media including optical disks, and a hardware apparatus designed to store and execute the programmed commands in ROM, RAM, a flash memory, and the like. Examples of the programmed commands include not only machine codes generated by a compiler but also include great codes to be executed in a computer by using an interpreter. The hardware apparatus may be configured to function as one or more software modules so as to perform operations of one or more exemplary embodiments.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more exemplary embodiments have been described with reference to the figures, it will be understood by those of ordinary skill in the art that various changes in form and details may be made therein without departing from the spirit and scope of the inventive concept as defined by the following claims.

The invention claimed is:

1. A method for detaching at least one compartment attached to a hull of a watercraft in response to a detected event, the method comprising:

detecting an event with respect to the at least one compartment attached to the hull of the watercraft; and causing, in response to detecting the event, a release of one or more attaching members from the at least one compartment that is attached to the hull of the watercraft, wherein the event is water level reaching a predetermined point in the at least one compartment.

2. The method of claim 1, wherein the detecting comprises detecting the event using a mechanical float installed in the at least one compartment.

3. The method of claim 2, wherein the mechanical float is configured to move in a predetermined direction in response to the water level rising in the at least one compartment, and configured to cause the release of the one or more attaching members from the at least one compartment that is attached to the hull of the watercraft in response to the water level reaching the predetermined point in the at least one compartment.

4. The method of claim 1, wherein the detecting comprises detecting the event using a detector installed in the at least one compartment.

5. The method of claim 4, wherein the detector detects whether the water level reaching the predetermined point in the at least one compartment and outputs a signal to a controller included in the at least one compartment in response to detecting that the water level reaches the predetermined point.

6. The method of claim 5, wherein the controller, in response to receiving the signal, activates an actuator which causes the release of the one or more attaching members from the at least one compartment that is attached to the hull of the watercraft.

7. A system for detaching at least one compartment attached to a hull of a watercraft in response to a detected event, the system comprising:

a float which detects an event with respect to the at least one compartment attached to the hull of the watercraft and which causes, in response to detecting the event, a release of one or more attaching members from the at least one compartment that is attached to the hull of the watercraft, wherein the detected event is water level reaching a predetermined point in the at least one compartment.

8. The system of claim 7, wherein the float is a mechanical float configured to move in a predetermined direction in response to the water level rising in the at least one compartment, and configured to cause the release of the one or more attaching members from the at least one compartment that is attached to the hull of the watercraft in response to the water level reaching the predetermined point in the at least one compartment.

9. A system for detaching at least one compartment attached to a hull of a watercraft in response to a detected event, the system comprising:

one or more processors configured to:

receive detection information regarding a detected event with respect to the at least one compartment attached to the hull of the watercraft; and cause, in response to receiving the detection information, a release of one or more attaching members from the at least one compartment that is attached to the hull of the watercraft, wherein the detected event is water level reaching a predetermined point in the at least one compartment.

10. The system of claim 9, further comprising:

a detector which detects the event, generates the detection information based on the detected event, and outputs the detection information to the one or more processors.

11. The system of claim 10, wherein the one or more processors, in response to receiving the detection information, cause the release of the one or more attaching members by activating an actuator which releases the one or more attaching members from the at least one compartment that is attached to the hull of the watercraft.

* * * * *